US005375702A

United States Patent [19]

Fiallo

[11] Patent Number: 5,375,702

[45] Date of Patent: Dec. 27, 1994

[54] FOLDING DISPLAY BOX

[75] Inventor: Orlando Fiallo, San Juan, Puerto Rico

[73] Assignee: Printech Inc., Cayey, Puerto Rico

[21] Appl. No.: 105,505

[22] Filed: Aug. 11, 1993

[51] Int. Cl.[5] ..... B65D 5/54

[52] U.S. Cl. ..... 206/45.21; 206/459.5

[58] Field of Search ..... 306/45.12, 45.14, 45.18, 306/45.2, 45.21, 45.23, 45.24, 45.27, 491, 459.5

[56] References Cited

U.S. PATENT DOCUMENTS

| | | | |
|---|---|---|---|
| 1,301,171 | 4/1919 | Richardson | 206/45.21 |
| 1,334,932 | 3/1920 | Gray | 206/45.21 |
| 1,358,659 | 11/1920 | Thum | 206/45.21 |
| 1,685,606 | 9/1928 | Leopold | 206/45.21 |
| 1,825,619 | 9/1931 | Whitehead | 206/45.21 |
| 2,137,906 | 11/1938 | Cummings | 206/45.21 |
| 2,186,170 | 1/1940 | Hall | 206/45.21 |
| 2,200,818 | 5/1940 | Bergstein | 206/45.21 |
| 2,787,371 | 4/1957 | Curtis | 206/45.21 |

OTHER PUBLICATIONS

Printech, Inc. WS0001 Carton Drawing -no date.

*Primary Examiner*—Jimmy G. Foster

*Attorney, Agent, or Firm*—Varnum, Riddering, Schmidt & Howlett

[57] ABSTRACT

A shipping box is disclosed which comprises a single piece of corrugated cardboard stock folded into a rectangular shipping container. A portion of an upper panel separates from the box to form a rear support, which attaches to the rear of the box to support the box in an upright, slightly sloping position, forming a point of sale display.

19 Claims, 4 Drawing Sheets

FOLDING DISPLAY BOX

BACKGROUND OF THE INVENTION

1. Field of the Invention

This invention relates to a folding box, and more specifically to a folding box which is convertible into a product display holder.

2. State of the Prior Art

It is known to form a folding box from a single sheet of corrugated cardboard or other heavy stock in the form of a foldable blank comprising a series of rectangular panels. The foldable blank has a bottom panel with a first front panel extending from one edge thereof, a rear panel extending from an opposite edge thereof and side panels extending from the remaining edges thereof. Tabs extend laterally from the first front panel and from the rear panel so that when the front and rear panels are folded upwardly normal to the bottom panel and the tabs are folded normal to the front and rear panels, respectively, the tabs are oriented vertically, normal to the bottom panel, and align with fold lines between the bottom panel and the side panels. The side panels fold upwardly normal to the bottom panel and then fold in half over the tabs. Tabs on the folded down portions of the side panels fit into slots in the bottom panel along the folding line between the bottom panel and the side panels to hold the sides firmly in position.

In the unfolded condition of the blank, a top panel extends from the rear panel opposite the bottom panel and a second front panel extends from the top panel opposite the rear panel. Also, generally rectangular flanges extend laterally from both the top panel and second front panel. To form the box, the flanges on the top panel fold normal to the top panel and the top panel folds normal to the rear panel whereby the top panel lies parallel to the bottom panel of the box with the flanges inside of the box. The second front panel thus folds downwardly over the first front panel and the lateral flanges on the second front panel are inserted between the folded over portions of the side panels to hold the box closed.

It is recognized that paper forms, such as lottery tickets and the like, are difficult to display in a vertical or sloping configuration. Typically, a merchant at the point of sale must provide a specific display rack sized to accommodate the forms. With variations in the sizes and quantities of forms displayed, a display rack sized to display many different sizes of paper forms may not perform adequately for each specific size of form. For instance, if the form is much narrower than the display rack, valuable space is wasted. Some merchants lay such forms horizontally, however, customers generally find a horizontal orientation more difficult to view, and the forms cannot be displayed at eye level horizontally.

SUMMARY OF THE INVENTION

A folding shipping and display box according to the invention comprises a stiff paperboard blank having an arrangement of fold lines forming a bottom panel, side panels, a rear panel, a top panel and at least one front panel all of which, when folded along the fold lines form a three dimensional rectangular box. Perforations across the top panel weaken the top panel for selectively separating a portion of the top panel from the blank. The separable portion of the top panel forms a rear support member. The rear support member has a pair of forwardly directed flanges, and slots formed in either the side or bottom panels receive at least portions of the rear support member flanges to secure the rear support member to the side or bottom panel. The rear support member is shaped to support the box in a rearwardly reclining position.

The front panel can have a pair of perforated lines and a fold line to define a front support panel which, when separated along the perforated lines and folded along the fold lines, forms a support for the box in the rearwardly reclining position. Preferably, there are two front panels, a first front panel joined to the bottom panel and a second front panel joined to the top panel. The pair of perforations and fold line are formed in the second front panel and extend from an attaching edge thereof, the attaching edge being parallel to the fold line. A slot in the first front panel receives the attaching edge of the second front panel.

Preferably, the rear support member further comprises a back portion, and the pair of forwardly directed flanges extend from the back portion of the rear support member. The forwardly directed flanges each have a sloping edge, which defines the reclining angle of the box in the reclining position, and tabs which fit into the slots in either the side or bottom panels. Preferably, the back portion of the forwardly directed flanges of the rear support member have bottom edges which are co-planar.

A remaining portion of the top panel can form a retention panel at one end of the box to retain contents in a portion of the box after removal of the rear support member from the top panel. The retention panel is preferably attached to the front panel. Preferably, the side panels extend upwardly from the bottom panel and further comprise a pair of apertures formed proximate the front panel. The retention panel has a pair of depending side flanges adjacent to the side panel; and the depending side flanges have locking tabs which are sized to fit within the apertures of the side panels to retain the retention panel in assembled position.

The folding shipping and display box can further include graphic and printed instructions thereon for instructing a user in converting the box from a folded shipping configuration, wherein the rear support member has yet to be removed from the top panel, into a shipping configuration, wherein the rear support member supports the box in a rearwardly reclining position.

DETAILED DESCRIPTION OF THE DRAWINGS

Figure 1:
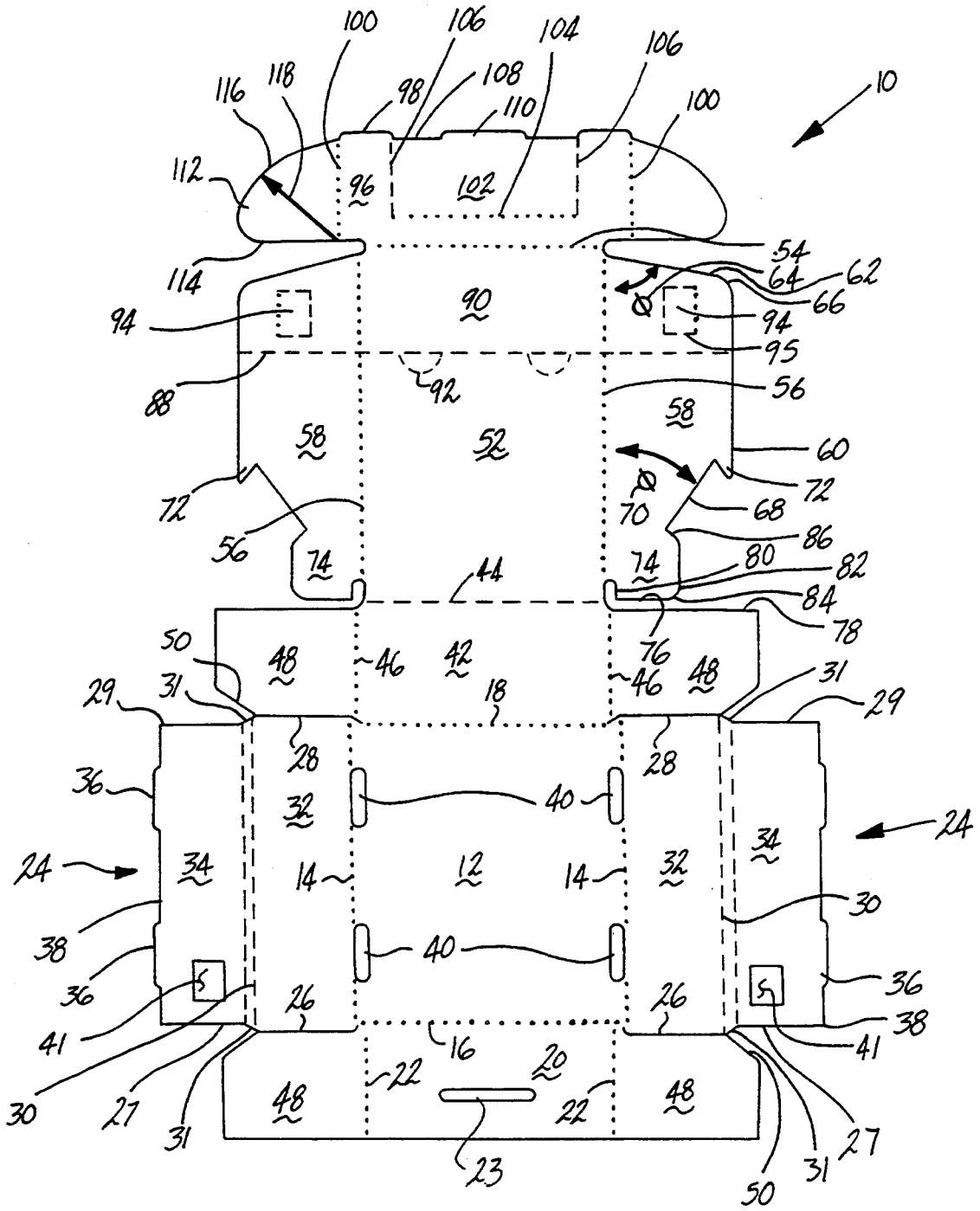
FIG. 1 is a top plan view of a folding box according to the invention, shown in the unfolded condition.

Turning now to the drawings, FIG. 1 illustrates a folding box 10 according to the invention. The folding box 10 is formed from a single sheet of corrugated cardboard, cut and folded as described hereinafter, foldable into a "shipping configuration" (FIG. 4) comprising a rectangular box for shipping a product (not shown). The assembled box is transformable into an upright "display configuration" (FIG. 8) for displaying the product at the product point of sale. In the drawings, dashed lines represent perforations in the folding box 10 and dotted lines represent folding lines. The folding lines comprise linear portions of the cardboard material which have been compressed, thereby overcoming the natural rigidity of the corrugated cardboard to facilitate folding of the cardboard material at the folding line.

For clarity, the box 10 will be described first in its unfolded condition. However, the part names generally refer to the location upon the box 10 in its folded condition. For instance, the box 10, in its unfolded condition, generally comprises a series of rectangular panels, specifically an inner front panel 20, a bottom panel 12, a rear panel 42, a top panel 52, and an outer front panel 96, all of which are arranged adjacent to each other in end to end relationship, and a pair of side panels 24 extending laterally from the bottom panel 12. Upon folding, these panels form the front, bottom, rear, top and sides of the box 10.

A pair of parallel side folding lines 14, a front folding line 16, and a parallel rear folding line 18 define the bottom panel 12. The inner front panel 20 extends outwardly from the bottom panel 12 at the bottom panel front folding line 16, and is defined by the bottom panel front folding lines 16, and front panel side folding lines 22. The inner front panel 20 is slightly narrower in width (as measured between the side folding lines 22) than the bottom panel 12. The inner front panel 20 further comprises an elongated lateral aperture 23, located in the center of the inner front panel 20.

The side panels 24 extend laterally from the bottom panel 12 at the side folding lines 14. A pair of spaced-apart parallel perforation lines 30, parallel to the bottom panel side folding lines 14, divide the side panels 24 into a inner side panel 32, adjacent the bottom panel 12, and a outer side panel 34. The width of the inner side panel 32 slightly exceeds the width of the outer side panel 34, and the distance between the parallel perforations lines 30 equals approximately three times the width of the corrugated cardboard material forming the folding box 10.

Front edges 26 and rear edges 28 further define the inner side panels 32, whereby the depth of the inner side panels 32 slightly exceeds the depth of the bottom panel 12. Similarly, front edges 27 and rear edges 29 further define the outer side panels 34. However, the depth of the bottom panel 12 slightly exceeds the depth of the outer side panels. The difference in depth between the inner and outer side panels 32, 34 forms sloping transition edges 31 between the inner side panel front edge 26 and outer side panel front edge 27, and between the inner side panel rear edge 28 and outer side panel rear edge 29. The transition edges 31 run generally between the parallel perforated lines 30.

A pair of shallow tabs 36 extend slightly outwardly from an outside edge 38 of each outer side panel 34. The bottom panel 12 contains four elongated cutouts 40, which are arranged with two of the cutouts 40 adjacent and parallel to each bottom panel side folding line 14. Each elongated cutout 40 registers laterally with one of the shallow tabs 36 on the adjacent side panel 24. Each outer side panel 34 also contains a rectangular aperture 41 therethrough, adjacent the front edge 27.

The back panel 42 extends rearwardly from the bottom panel 12 at the rear folding line 18. The bottom panel rear folding line 18, a parallel perforated back panel folding line 44, and two back panel side folding lines 46 define the back panel 42. The width of the back panel 42 is slightly less than the width of the bottom panel 12. The depth of the back panel 42 equals the width of the inner side panels 32, and is slightly less than the depth of the inner front panel 20.

Retention tabs 48 extend laterally from the inner front panel 20 and rear panel 42 at their respective side folding lines 22, 46. The retention tabs 48 are essentially rectangular in shape, having a depth slightly less than the depth of the respective inner front panel 20 and rear panel 42. The width of the retention tabs 48 slightly exceeds their depth. Each retention tab 48 has one chamfered corner 50, away from its respective folding line 22 or 46, and adjacent its respective side panel 24.

The top panel 52 extends rearwardly from the rear panel 42, at its rear folding line 44, and is defined by the rear panel rear folding line 44, a parallel top panel rear folding line 54, and two top panel side folding lines 56. The width of the top panel 52 is slightly narrower than the width of the back panel 42, and the depth of the top panel 52 slightly exceeds the depth of the bottom panel 12.

Upper side panels 58 extend laterally from the upper panel 52 along its side folding lines 56. Each upper side panel 58 is defined by the respective upper panel side folding line 56 and a parallel outer edge 60. A rear edge 62 of the outer side panel 58 slopes slightly from the upper panel side folding line 56 to the outer side panel outside edge 60, forming a slightly acute angle 64 with the upper panel side folding line 56, and having a slightly rounded transition 66 to the outer side panel outer edge 60. An upper side panel forward edge 68 slopes more radically between the upper panel side folding edge 56 and outer side panel outer edge 60, forming an acute angle 70 with the upper panel side folding line 56. The forward edge angle 70 equals the angle of recline of the folding box 10 in its display position, as will be more fully described hereinafter.

A small triangular tab 72, having as one edge thereof the outer side panel outer edge 60, extends outwardly from the outer side panel forward edge 68. A larger second tab 74, having an essentially truncated rectangular shape, extends outwardly from the outer side panel forward edge 68 adjacent the upper panel side folding line 56. The second tab 74 has a forward edge 76 parallel and adjacent to a rear edge 78 of the adjacent retention tab 48. The second tab 74 has a short inside edge 80 which is parallel to and spaced slightly apart from the upper panel side folding line 56. The second tab 74 also has an outside edge 82 parallel to its inside edge 80. A rounded transition 84 is provided between the second tab forward edge 76 and outside edge 82. Also, the second tab outside edge 82 does not extend to meet the outer side panel forward edge 68. Instead, a short transition edge 86 extends from the second tab outside edge 82 toward the outer side panel forward edge 68, at a slightly acute angle thereto. The length of the outer side panel forward edge 68, between the small triangular tab 72 and the second tab 74 equals the distance between the elongated openings 40 along the bottom panel side folding edges 14.

A perforated line 88 extends laterally across the upper panel 52 and upper side panels 58, parallel the upper panel rear folding line 54. The perforated line 88 thus defines a retention panel 90 formed of the upper panel 52. The function of the retention panel 90 will be more fully described hereinafter in reference to the display position of the folding box 10. A pair of semicircular perforated lines 92 along the perforated line 88 provide openings into which a user may insert his or her fingers as will be more fully described hereinafter. Also, rectangular locking tabs 94, having perforations along three sides 95, are provided on each outer side panel 58 between its rear edge 62 and the perforated line 88. Each locking tab 94 fits within the rectangular apertures 41 when the box 10 is folded.

The outer front panel 96 extends rearwardly from the upper panel 52 at its rear folding line 54. The rectangular outer front panel 96 is defined by the upper panel rear folding line 54, parallel rear edge 98, and two parallel side folding lines 100. The width of the outer front panel 96 equals the width of the rear panel 42.

The outer front panel 96 encompasses a front support panel 102 bounded by the outer front panel rear edge 98, a parallel perforated front support panel front folding line 104, and two parallel front support panel side folding lines 106. The front support panel 102 is rectangular in shape, comprising approximately three-quarters of the area of the outer front panel 96, and is positioned midway between the outer front panel side folding lines 100. Two shallow rectangular cutouts 108 in the front support panel 102 along the rear edge 98 and abutting the side folding lines 106 define a shallow rectangular tab 110.

Semicircular tabs 112 extend laterally from the outer front panel 96 at its side folding lines 100. Each of the semicircular tabs 112 has a front edge 114 parallel to, and slightly to the rear of, the upper panel rear folding line 54. Each of the semicircular tabs 112 also comprises a semicircular rear edge 116, arcing from the outer end of the front edge 114 rearwardly and inwardly to the outer front panel side folding line 100. The semicircular tab rear edge 116 has a radius of curvature 118 approximately one-third the length of the bottom panel.

Figure 2:
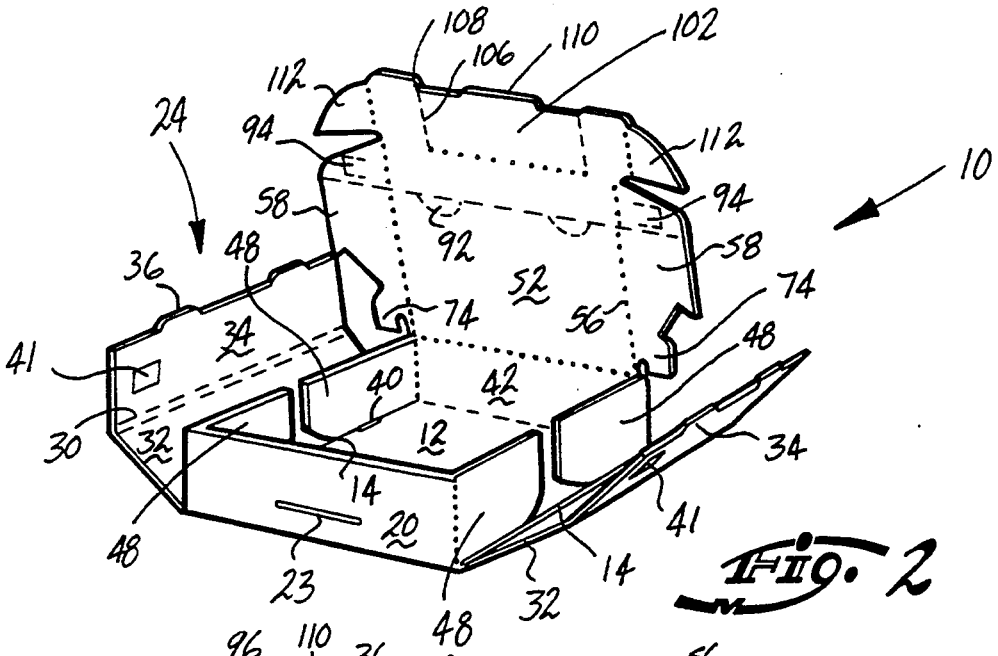
FIG. 2 is a perspective view of the box of FIG. 1, showing an initial stage of folding.
Figure 3:
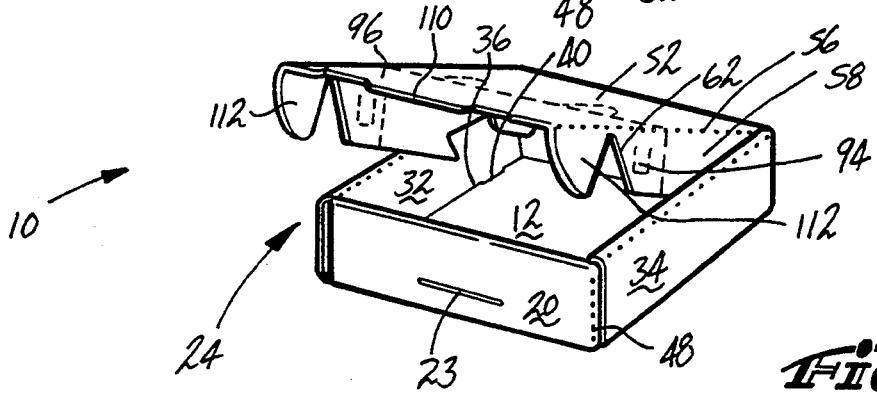
FIG. 3 is a perspective view of the box of FIG. 1, showing a second stage of folding.
Figure 4:
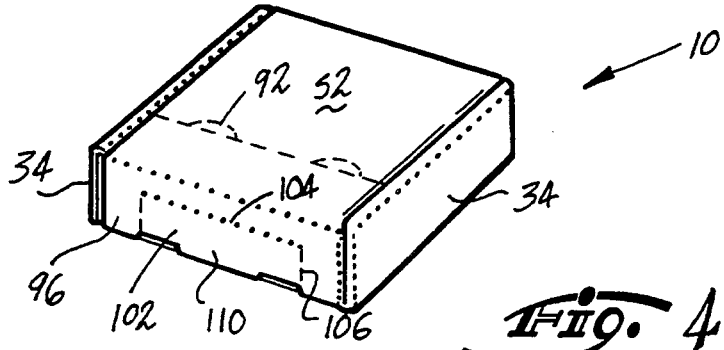
FIG. 4 is a perspective view of the box of FIG. 1, folded into a shipping configuration.

FIGS. 2 through 4 illustrate how the box is folded into its shipping configuration illustrated in FIG. 4. Turning to FIG. 2, the inner front panel 20 and the rear panel 42 fold upwardly, normal to the bottom panel 12. Each of the tabs 48 folds inwardly to align with the bottom panel side folding lines 14. The side panels 24 then fold upwardly and over the retention tabs 48. Turning to FIG. 3, the retention tabs 48 are thus disposed between the inner side panel 32 and the outer side panel 34, and the shallow tabs 36 on the outer side panel 34 are received within the elongated openings 40 in the bottom panel 12.

To enclose the box 10, the upper side panels 58 fold normal to the upper panel 52, and the upper panel 52 folds normal to the rear panel 42 with the upper side panels 58 received inside of the side panels 24. The curved rear edges 62 of the side panels 58 facilitates insertion of the side panels 58 into the box 10 inside of the inner front panel 20. To hold the box 10 in its closet shipping configuration, the semicircular tabs 112 fold normal to the outer front panel 96, and the outer front panel 96 folds over the inner front panel 20, with the semicircular tabs 112 received between the inner and outer side panels 32, 34. The curved rear edges 116 of the semicircular tabs 112 facilitate insertion of the tabs into the space between the inner and outer side panels 32, 34.

The slight differences between the heights and depths of the various mating panel sections as set forth hereinbefore facilitate assembly of the various panel sections into a tight fitting configuration without undue stress upon any of the folding lines. For instance, the depth of the upper panel 52 slightly exceeds the depth of the bottom panel 12 so that the outer front panel 96 can easily fold over the inner front panel 20.

Figure 5:
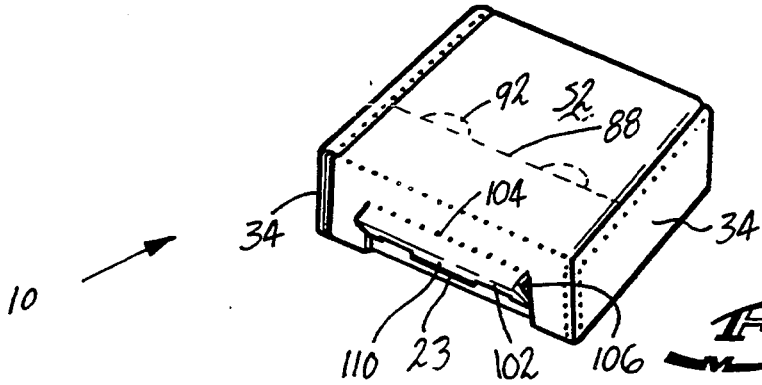
FIG. 5 is a perspective view of the box of FIG. 1, showing an initial stage of conversion into a display configuration.
Figure 6:
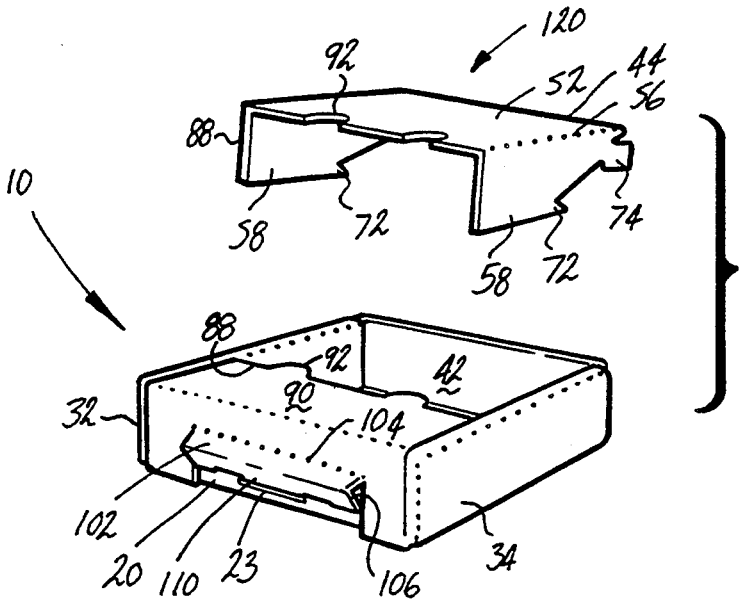
FIG. 6 is a perspective view of the box of FIG. 1, showing a second stage of conversion into a display configuration.
Figure 7:
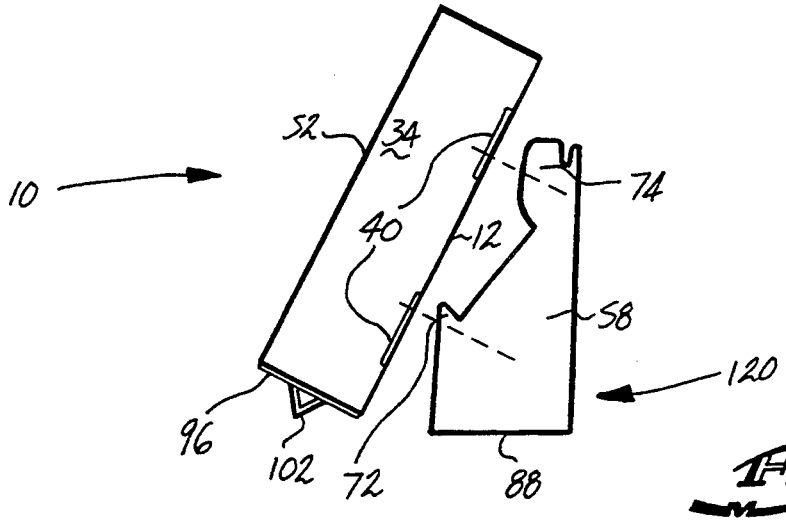
FIG. 7 is a perspective view of the box of FIG. 1, showing a third stage of conversion into a display configuration.
Figure 8:
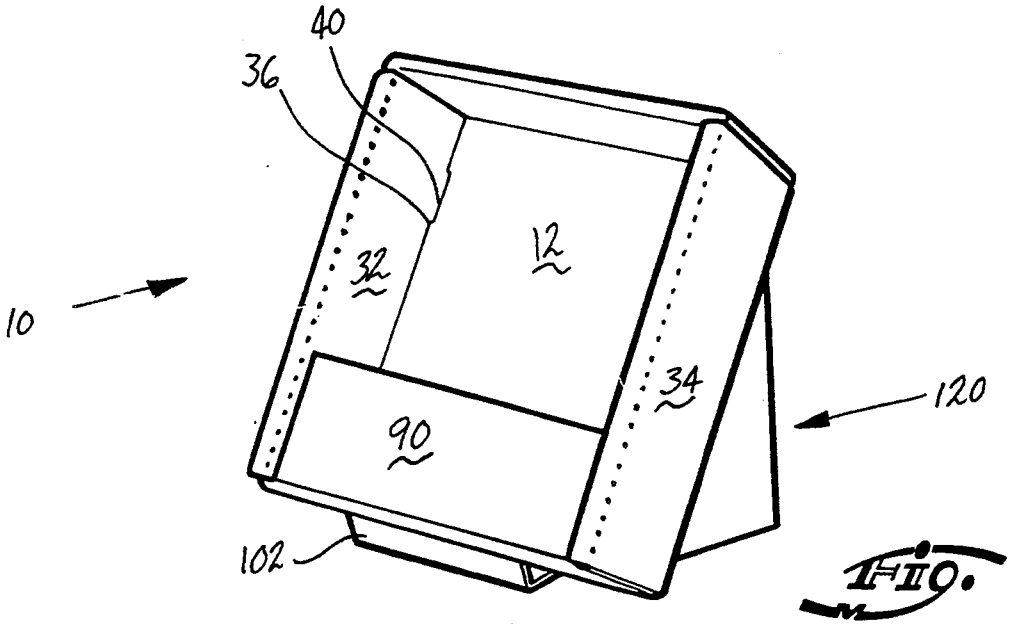
FIG. 8 is a perspective view of the box of FIG. 1, converted into a display configuration.

FIGS. 5 through 8 illustrate conversion of the box from the shipping configuration illustrated in FIG. 4 into the display configuration illustrated in FIG. 8. Turning to FIG. 5, the front support panel 102 is partially separated along perforation lines 106, and the front support panel 102 is folded along its front folding line 104. The shallow tab 110 is then inserted into the elongated lateral aperture 23 in the inner front panel 20. The front support panel 102 thus assumes a triangular cross-sectional configuration.

Turning to FIG. 6, a rear support member 120 comprises those portions of the top panel 52 and the upper side panels 58 between the top panel front folding line 44 and the lateral perforated line 88. The rear support member 120 separates from the box 10 along the perforated line 88 and along the perk}rated rear panel front folding line 44. Placing a finger through each of the semicircular perforated lines 92 along the perforated line 88 provides an internal gripping area for one to separate the rear support member 120 from the retention panel 90. After removal of the rear support member 120, the locking tabs 94 are pressed firmly into the rectangular apertures 41 (see FIG. 1) to more securely hold the retention panel 90 in place.

Turning to FIG. 7, the rear support member 120 is attached to the rear of the box 10 by inserting the triangular tab 72 and the rectangular second tab 74 into the elongated openings 40 through the rear of the bottom panel 12.

As shown in FIG. 8, in the display position, the box 10 rests upon the perforated edge 88 of the rear support member 120, upon the front folding line 16 between the bottom panel 12 and inner front panel 20, and also upon the front support panel 102. The box 10 reclines to present the product (not shown) contained within the box at a pleasing angle to a consumer's eye and the retention panel 90 prevents the product from falling out of the box 10. The box 10 is particularly well suited for displaying paper forms and the like.

Figure 9:
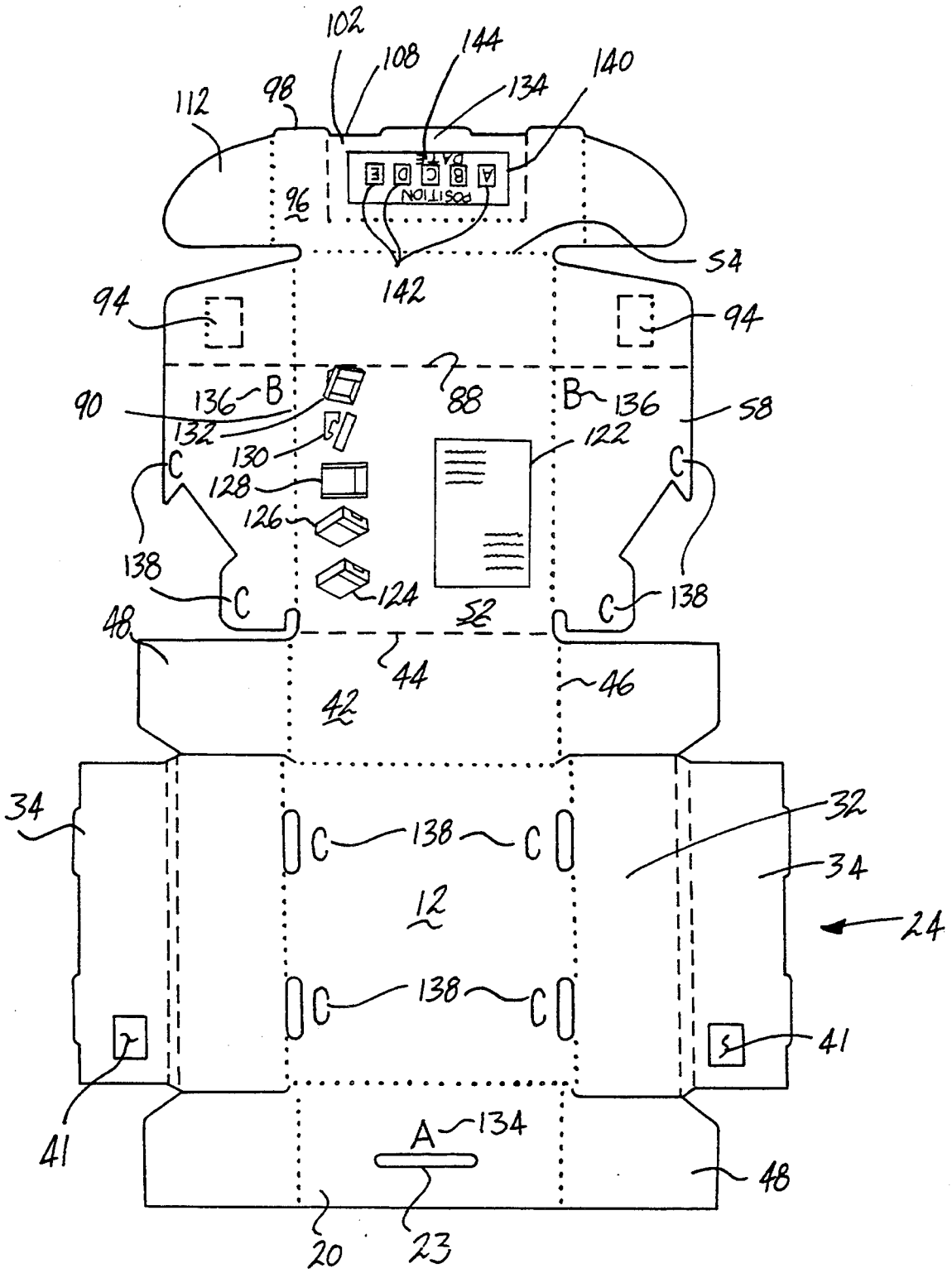
FIG. 9 is a bottom plan view of the box of FIG. 1 in its unfolded condition, illustrating printed conversion instructions thereon.

FIG. 9 illustrates printing provided on the box 10 to provide instructions to a point-of-sale merchant for converting the box from its shipping configuration into the display configuration. The outwardly facing side of the upper panel 52 is provided with written instructions 122 and a series of diagrams 124, 126, 128, 130 and 132, illustrating the intermediate steps of converting the box 10 into the display configuration. Diagram 124 shows the box in the shipping configuration; diagram 126 shows the shallow tab 110 on the front support panel 102 inserted into the elongated lateral aperture 23 in the inner front panel 20 (as shown in FIG. 5); diagram 128 shows the rear support member 120 being removed along perforated lines 88 and 44; diagram 130 shows the rear support member 120 in position to be inserted into the rear of the bottom panel 12; and diagram 132 shows the box 10 in the display configuration. Also, a large letter "A" 134 printed on the shallow tab 110 and a second letter "A" 134 printed adjacent the elongated lateral aperture 23 illustrates their interconnection. A large letter "B" 136 is printed adjacent the perforated line 88 and finger hole perforations 92. A large letter "C" 138, printed adjacent each elongated opening 40 and on each of the triangular tabs 72 and second rectangular tabs 74, illustrates their interconnection.

As seen in FIG. 9, the front support panel 102 has a printed position indicator 140 with five squares 142, each one with a different letter. Each letter corresponds to a position of the contents of the box in a printing run. In a preferred embodiment of the invention, a series of lottery tickets is packaged in the boxes. The tickets are run five across in a printing operation. Each row of tickets is packaged in a separate box for quality control purposes. The particular row of each box of tickets is marked on the box in one of the squares 142. The date or the run is also marked on the box in date block 144. The number of squares 142 can vary depending on the number of rows of tickets printed. Thus, more than five or less than five boxes can be used. Further, there can be more squares 142 than rows of printed tickets. Further, numbers or other differentiating indicia can be used in the squares 142. The box can be used to package any type of cards or tickets. The use of the box is not limited to lottery tickets.

While particular embodiments of the invention have been shown, it will be understood, of course, that the invention is not limited thereto since modifications can be made by those skilled in the art, particular in light of the foregoing teachings. Reasonable variation and modification are possible within the foregoing disclosure of the invention without departing from the spirit of the invention.

The embodiments of the invention in which an exclusive property or privilege is claimed are defined as follows:

1. A folding shipping and display box comprising:

a stiff paperboard blank having an arrangement of fold lines forming a bottom panel, side panels, a rear panel, a top panel and at least one front panel all of which, when folded along the fold lines, form a three dimensional rectangular box:

perforations across the top panel for separating a portion of the top panel from the blank, the separated portion of the top panel forming a rear support member;

the rear support member having a pair of forwardly directed flanges extending from side edges of the top panel;

slots formed in the blank between the side and bottom panels for receipt of at least portions of the rear support member flanges to secure the rear support member to the side or bottom panel; and the rear support member being shaped to support the box in a rearwardly reclining position.

2. A folding shipping and display box according to claim 1 wherein:

the at least one front panel comprises a first front panel joined to the bottom panel and a second front panel joined to the top panel; and a pair of perforated lines and a fold line are formed in the second front panel and extend from an attaching edge thereof to define a front support panel which, when separated along the perforated lines and folded along the fold line, forms a support for the box in the rearwardly reclining position, the attaching edge being parallel to the fold line; and the folding, shipping and display box has a slot in the first front panel to receive the attaching edge of the second front panel.

3. A folding shipping and display box according to claim 2 wherein the rear support member further comprises a back portion and the pair of forwardly directed flanges extend from the back portion of the rear support member.

4. A folding shipping and display box according to claim 3 wherein the forwardly directed flanges further comprise a sloping edge, which defines the reclining angle of the box in the reclining position, and tabs which fit into the slots in one of the side and bottom panels.

5. A folding shipping and display box according to claim 3 wherein the back portion of the forwardly directed flanges of the rear support member have bottom edges which are co-planar.

6. A folding shipping and display box according to claim 5 wherein a remaining portion of the top panel forms a retention panel at one end of the box to retain contents in a portion of the box after removal of the rear support member from the top panel.

7. A folding shipping and display box comprising:

a stiff paperboard blank having an arrangement of fold lines forming a bottom panel, side panels, a rear panel, a top panel and at least one front panel all of which, when folded along the fold lines, form a three dimensional rectangular box;

perforations across the top panel for separating a portion of the top panel from the blank, the separated portion of the top panel forming a rear support member;

the rear support member having a pair of forwardly directed flanges;

slots formed in one of the side and bottom panels for receipt of at least portions of the rear support member flanges to secure the rear support member to the side or bottom panel;

the rear support member being shaped to support the box in a rearwardly reclining position; and the at least one front panel having a pair of perforated lines and a fold line to define a front support panel which, when separated along the perforated lines and folded along the fold lines, forms a support for the box in the rearwardly reclining position.

8. A folding shipping and display box according to claim 7 wherein:

the at least one front panel comprises a first front panel joined to the bottom panel and a second front panel joined to the top panel;

the pair of perforations and fold line are formed in the second front panel and extend from an attaching edge thereof, the attaching edge being parallel to the fold line; and the folding, shipping and display box has a slot in the first front panel to receive the attaching edge of the second front panel.

9. A folding shipping and display box according to claim 8 wherein the rear support member further comprises a back portion and the pair of forwardly directed flanges extend from the back portion of the rear support member.

10. A folding shipping and display box according to claim 9 wherein the forwardly directed flanges further comprise a sloping edge, which defines the reclining angle of the box in the reclining position, and tabs which fit into the slots in one of the side and bottom panels.

11. A folding, shipping, and display box according to claim 10 wherein, when the box is in the rearwardly reclining position, the tabs on the forwardly directed flanges extend upwardly into the slots whereby forward movement of the box relative to the rear support member is prevented by the tabs.

12. A folding shipping and display box according to claim 9 wherein the back portion of the forwardly directed flanges of the rear support member have bottom edges which are co-planar.

13. A folding shipping and display box according to claim 12 wherein a remaining portion of the top panel forms a retention panel at one end of the box to retain contents in a portion of the box after removal of the rear support member from the top panel.

14. A folding shipping and display box according to claim 13 wherein the retention panel is attached to the at least one front panel.

15. A folding shipping and display box according to claim 14 wherein:

the side panels extend upwardly from the bottom panel and further comprise a pair of apertures formed proximate the front panel;

the retention panel has a pair of depending side flanges adjacent to the side panel; and the depending side flanges have locking tabs which are sized to fit within the apertures of the side panels to retain the retention panel in assembled position.

16. A folding shipping and display box comprising:

a stiff paperboard blank having an arrangement of fold lines forming a bottom panel, side panels, a rear panel, a top panel and at least one front panel all of which, when folded along the fold lines, form a three dimensional rectangular box;

perforations across the top panel for separating a portion of the top panel from the blank, the separated portion of the top panel forming a rear support member;

the rear support member having a pair of forwardly directed flanges;

slots formed in one of the side and bottom panels for receipt of at least portions of the rear support member flanges to secure the rear support member to the side or bottom panel;

the rear support member being shaped to support the box in a rearwardly reclining position; and graphic and printed instructions on the box for instructing a user in converting the box from a folded shipping configuration wherein the rear support member has yet to be removed from the top panel into a shipping configuration wherein the rear support member supports the box in a rearwardly reclining position.

17. A folding shipping and display box comprising:

a stiff paperboard blank having an arrangement of fold lines forming a bottom panel, side panels, a rear panel, a top panel and at least one front panel all of which, when folded along the fold lines, form a three dimensional rectangular box configuration;

perforations across the top panel for separating a portion of the top panel from the blank, the separated portion of the top panel forming a rear support member and leaving a remaining portion of the top panel as a part of the blank attached to said front panel;

the rear support member having a pair of forwardly directed flanges;

slots formed in one of the side and bottom panels for receipt of at least portions of the rear support member flanges to secure the rear support member to the side or bottom panel;

the rear support member being shaped to support the box in a rearwardly reclining position; and when the box is assembled into said three dimensional rectangular box configuration and is in said rearwardly reclining position, the rear support member stably supports the box in the rearwardly reclining position with the forwardly directed flanges on the rear support member received in the slots and the remaining portion of the top panel is substantially parallel to the back panel and forms a retention panel at one end of the box to retain contents in a portion of the box.

18. A folding shipping and display box comprising:

a stiff paperboard blank having an arrangement of fold lines forming a bottom panel, side panels, a rear panel, a top panel and at least one front panel all of which, when folded along the fold lines, form a three dimensional rectangular box;

perforations across the top panel for separating a portion of the top panel from the blank, the separated portion of the top panel forming a rear support member;

the rear support member having a pair of forwardly directed flanges;

slots formed in one of the side and bottom panels for receipt of at least portions of the rear support member flanges to secure the rear support member to the side or bottom panel;

the rear support member being shaped to support the box in a rearwardly reclining position; and a plurality of indicia on one of said panels, said indicia being representative of a number of rows of printed materials which are printed along with the printed materials in the box, printed material from only one of said rows is packaged in the box, one of said indicia being further marked to indicate the row of printing corresponding to the printed materials in the box.

19. A package comprising:

a three-dimensional rectangular shipping box formed by a stiff paperboard blank having an arrangement of fold lines forming a bottom panel, side panels, a rear panel, a top panel and at least one front panel, all of which, when folded along the fold lines, form the three-dimensional rectangular box;

printed materials filling said box, said printed materials being printed on one of several rows from a single press;

said box having on one of said panels a plurality of indicia representative of the several rows of printing from a printing press; and one of said indicia being marked with a row indicia, said row indicia corresponding to the one of said several rows from which originated said printed materials in said box;

whereby said marked indicia indicate which of the several rows printed from the single printing press is present in the box.

* * * * *